US009522765B2

(12) United States Patent
Ramprasad

(10) Patent No.: US 9,522,765 B2
(45) Date of Patent: Dec. 20, 2016

(54) WIRELESS DEVICE PACKAGING CONFIGURED TO BE CUSTOMIZABLE FOR A PARTICULAR BRAND AND/OR NETWORK

(71) Applicant: TracFone Wireless, Inc., Miami, FL (US)

(72) Inventor: Satish Ramprasad, Miramar, FL (US)

(73) Assignee: TracFone Wireless, Inc., Miami, FL (US)

( * ) Notice: Subject to any disclaimer, the term of this patent is extended or adjusted under 35 U.S.C. 154(b) by 97 days.

(21) Appl. No.: 14/075,022

(22) Filed: Nov. 8, 2013

(65) Prior Publication Data

US 2015/0129450 A1 May 14, 2015

(51) Int. Cl.
*B65D 85/00* (2006.01)
*B65D 25/20* (2006.01)
*B65D 25/02* (2006.01)

(52) U.S. Cl.
CPC ..... *B65D 25/205* (2013.01); *B65D 25/02* (2013.01); *B65D 2585/86* (2013.01)

(58) Field of Classification Search
USPC ..... 206/576, 320, 701, 459.1, 459.5
See application file for complete search history.

(56) References Cited

U.S. PATENT DOCUMENTS 8,762,704 B2 * 6/2014 Rothkopf ..... G06F 1/1626 206/320
2004/0262179 A1 * 12/2004 Gartrell ..... A45C 11/00 206/320
2009/0325657 A1 * 12/2009 Ramsdell ..... A45C 7/0063 455/575.8
2010/0078343 A1 * 4/2010 Hoellwarth ..... B29C 45/14639 206/320
2011/0315567 A1 * 12/2011 Boynton ..... A45C 11/16 206/6.1
2012/0081213 A1 * 4/2012 Rosenblatt ..... B65D 75/52 340/10.34
2012/0261306 A1 * 10/2012 Richardson ..... G06F 1/1626 206/778
2013/0098788 A1 * 4/2013 McCarville ..... A45C 11/00 206/320
2014/0008260 A1 * 1/2014 Kanaya ..... H04M 1/0283 206/459.5
2014/0113610 A1 * 4/2014 Ramprasad ..... G06Q 10/10 455/418
2014/0346075 A1 * 11/2014 Schecter ..... G06F 1/1626 206/459.5
2015/0053583 A1 * 2/2015 McCormick ..... A45C 11/00 206/521
2016/0020807 A1 1/2016 Chen

* cited by examiner

*Primary Examiner* — Jacob K Ackun
(74) *Attorney, Agent, or Firm* — Baker & Hostetler LLP

(57) ABSTRACT

The present disclosure includes a customizable packaging and method of customizing the packaging for an electronic device configurable to operate under a plurality of different brands and with a plurality of different networks. The brand and network to be utilized are designated at the point-of-sale, during activation, by the seller, and/or by the user. The customizable packaging and method include selecting from a plurality of labels and instructions manuals corresponding to the brand and/or network selected for the electronic device to operate under. The designation of a brand and/or network to be utilized can take place at the point-of-sale, during activation, by the seller, and/or by the user.

21 Claims, 7 Drawing Sheets

WIRELESS DEVICE PACKAGING CONFIGURED TO BE CUSTOMIZABLE FOR A PARTICULAR BRAND AND/OR NETWORK

BACKGROUND OF THE DISCLOSURE

1. Field of the Disclosure

This disclosure relates generally to packaging for a wireless device that can be configured to operate under a plurality of different brands and/or with a plurality of different networks. More particularly, the disclosure relates generally to customizable packaging for a wireless device that can be configured to operate under a plurality of different brands and/or with a plurality different networks. The customization may take place when the brand and/or network to be utilized is designated prior to shipping, at a distribution center, at the point-of-sale, during activation, by the seller and/or at some intermediate point.

2. Related Art

Generally, most wireless devices are sold to users having a configuration to operate as a particular brand and/or on a particular wireless network or wireless virtual network. The configurations can include various software components, system settings, network settings, network and/or operator applications, brand customization features and the like. For example, it is common practice to customize and apply different settings to the same wireless phone (i.e. same manufacturer and model) by the service provider. Phones will typically be either loaded with software to make such phones both compatible with the network of a specific brand but also, due to the subsidy applied to the cost of phones, to make such phones incompatible with the networks of others, including brands owned by the same entity. Similarly, the packaging for the wireless device is typically specifically designed and manufactured for a particular brand and/or a particular wireless network.

This approach requires a wireless device seller, distributor, or the like to manage an inventory of phones and packaging for each type of configuration. In other words, a single type of wireless device will typically have to be configured by the manufacturer for each brand, each network operator and/or mobile virtual network operator. Moreover, packaging will need to be designed and manufactured for each brand, each network operator and/or mobile virtual network operator. This results in a much greater inventory of wireless devices. In addition to the greater inventory, this also requires a wireless device seller to be able to anticipate the demands for a particular phone configured for a particular brand, mobile network operator and/or mobile virtual network operator. Additionally, users of phones will be required to purchase the same phone (again at a cost to the service provider due to the subsidy) to make the wireless device operate with another brand even with the same service provider.

Accordingly, there is a need for customizable packaging for a wireless device and a customizable wireless device that may be customized to operate under a desired brand, on a desired mobile network and/or virtual mobile network in order to reduce costs associated with packaging, distribution, inventory, and the like.

SUMMARY OF THE INVENTION

The foregoing needs are met, to a great extent, by the invention, with a customizable package for a wireless device configured to be customized and configured for a particular brand and/or for a particular wireless network when the brand and/or network to be utilized is determined prior to shipping, at a distribution center, at the point-of-sale, during activation, by the seller and/or at some intermediate point. In particular, the invention is intended to solve the challenges of inventory management of identical phones and/or packaging that is customized for a particular brand.

In one aspect, the invention includes a method of customizing a package for a wireless device configured to operate under at least one of a plurality of different brands and with a plurality of different networks. The method includes providing a generic package assembly, wherein the generic package assembly comprises a portion to hold the wireless device, a document compartment, and a label receptacle portion configured to hold a label for the packed wireless device, determining at least one of a brand and a network associated with the wireless device, configuring the wireless device according to the determination of at least one of the brand and network associated with the wireless device, providing at least one document in the document compartment according to said at least one of the brand and the network determined, and providing a label for the label receptacle portion of the generic package assembly associated with the wireless device according to said at least one of the brand and the network determined.

In another aspect, the invention includes a customizable generic package assembly for a wireless device configured to operate under at least one of a plurality of different brands and with a plurality different networks, the customization of the generic package assembly configured according to the brand and/or network designated at one of a distributor, seller, and point-of-sale. The customizable generic package assembly includes a wireless device configured to be designated for at least one of a brand and a network at one of a distributor, seller, and point-of-sale, a packaging assembly including a portion to hold the wireless device, a document compartment associated with the packaging assembly and configured to hold at least one document, and a label receptacle portion associated with the packaging assembly and configured to hold at least one label.

In yet another aspect, the invention include a customizable generic package assembly for a wireless device configured to operate under at least one of a plurality of different brands and with a plurality different networks, the customization of the generic package assembly configured according to the brand and/or network designated at one of a distributor, seller, and point-of-sale. The customizable generic package assembly including a wireless device configured to be designated for at least one of a brand and a network at one of a distributor, seller, and point-of-sale, a packaging assembly including a portion to hold the wireless device, a document compartment associated with the packaging assembly and configured to hold at least one document, and a label receptacle portion associated with the packaging assembly and configured to hold at least one label, wherein the wireless device is configured to be designated for said at least one of a brand and a network associated at one of a distributor, seller, and point-of-sale, wherein the label receptacle portion comprises at least one of a label receiving surface configured to receive the label, a label receiving slot configured to receive the label, and an inner portion of the generic package assembly configured to receive the label.

There has thus been outlined, rather broadly, certain aspects of the invention in order that the detailed description thereof herein may be better understood, and in order that the present contribution to the art may be better appreciated. There are, of course, additional aspects of the invention that will be described below and which will form the subject matter of the claims appended hereto.

In this respect, before explaining at least one aspect of the invention in detail, it is to be understood that the invention is not limited in its application to the details of construction and to the arrangements of the components set forth in the following description or illustrated in the drawings. The invention is capable of aspects in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the invention. It is important, therefore, that the claims be regarded as including such equivalent constructions insofar as they do not depart from the spirit and scope of the invention.

DETAILED DESCRIPTION

Glossary

Figure 1:
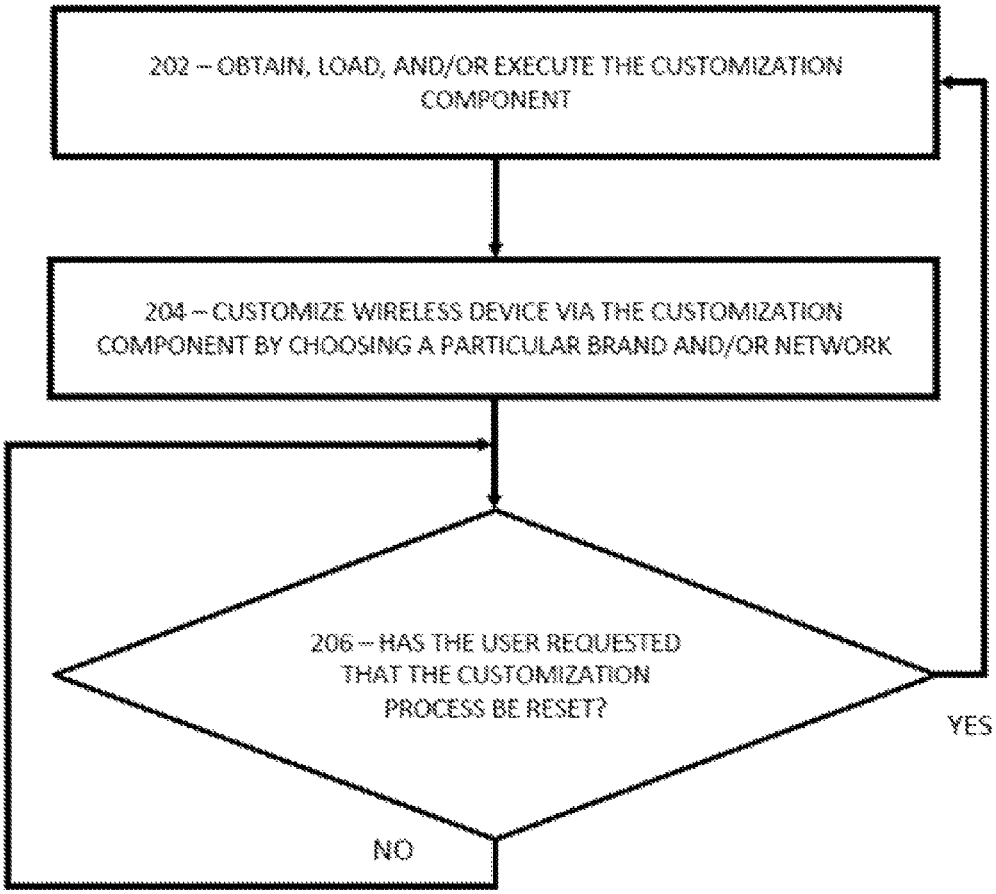
FIG. 1 shows a process of customizing a wireless device in accordance with some aspects of the disclosure.

"Generic packaging assembly" as used herein, generic packaging assembly refers to packaging for a wireless device that can be suitable for more than one brand and/or network by means of a customization component. In some aspects, the generic packaging assembly can include wireless device information, including for example a picture of the electronic device, and at least one label receptacle portion for one or more label(s) to be selected and associated with the label receptacle portion(s). The one or more labels can refer to at least one of a brand and a network. In some aspects, a compartment can be also included in the generic packaging assembly for a booklet, such as instruction manuals, instructions, disclaimer, and/or user agreement (documents), to be placed according to the brand and/or network designated. In additional aspects, the generic packaging assembly can include a wire passageway suitable to provide a connection to the enclosed wireless device without having to open the packaging assembly. In additional aspects, the generic packaging may be configured to be inserted into specific non-generic packaging that includes one or more labels that refer to at least one of a brand and a network and can include an instruction manuals, instructions, disclaimer, and/or user agreement (documents). For example, the generic packaging for a wireless device may be configured to be inserted into a label that forms part of the generic packaging assembly in the form of a partial or full enclosure, such as a sleeve or blister pack, and which includes one or more labels that refer to at least one of a brand and a network. In yet additional aspects, a label of this form can include an instructions, manuals, disclaimers, and/or user agreements as part of the label enclosure.

"Label receptacle portion" as used herein, may refer to a surface on which one or more labels relating to at least one of a brand and or a network can be located. In some aspects, the label receptacle portion may be a surface that forms part of the generic packaging assembly, including for example, a designated space, a mating feature for a label to be connected thereto, a flat surface on a portion of the removable cover, and/or a shrink-wrapped surface on which a label sticker may be placed onto. Additionally, the label receptacle portion may include a slot or the like within the generic packaging configured to receive a label. Furthermore, the label receptacle portion may be an internal portion of the generic packaging that includes a transparent portion. The label receptacle portion located within the transparent generic packaging. In a further aspect, the label may be a printed label and the label receptacle portion may be a portion configured to receive printing. Finally, the label receptacle portion, as described above, may also be arranged similarly in packaging configured to receive the generic packaging.

"Point-of-sale" as used herein, point-of-sale can refer to a location where one or more wireless devices can be sold, distributed, and/or activated. A point-of-sale can include for example, a kiosk, a store, a warehouse, a distribution center, and such.

In addition to the defined terms, in this specification and claims it is to be understood that reference to an electronic device is intended to encompass wireless devices such as mobile phones, tablet computers, gaming systems, MP3 players and the like. A "wireless device" is intended to encompass any compatible mobile technology computing device that connects to a wireless communication network, such as mobile phones, mobile equipment, mobile stations, user equipment, cellular phones, smartphones, handsets or the like (e.g., Apple iPhone, iPad, Google Android based devices, BlackBerry based devices, other types of PDAs or smartphones), wireless dongles, or other mobile computing devices. The term "wireless device" may be interchangeably used and referred to herein as "wireless handset," "handset," "mobile device," "device," "mobile phones," "mobile equipment," "mobile station," "user equipment," "cellular phone," "smartphones," or "phone."

Wireless devices may connect to a "wireless network" or "network" and are intended to encompass any type of wireless network to obtain mobile phone services through the use of a wireless device, such as the Global System for Mobile Communication (GSM) network, Code-Division Multiple Access (CDMA) network or the like using a communication channel as described herein, that may utilize the teachings of the present application to allow a wireless device to connect to a wireless network.

Reference in this specification to "one aspect," "an aspect," "other aspects," "one or more aspects" or the like means that a particular feature, structure, or characteristic described in connection with the aspect is included in at least one aspect of the disclosure. The appearances of, for example, the phrase "in one aspect" in various places in the specification are not necessarily all referring to the same aspect, nor are separate or alternative aspects mutually exclusive of other aspects. Moreover, various features are described which may be exhibited by some aspects and not by others. Similarly, various requirements are described which may be requirements for some aspects but not other aspects.

Certain companies that provide postpaid wireless services, such as mobile phone service, can be wireless carriers or Mobile Network Operators (MNO) that maintain and control their own wireless networks. An MNO relies heavily on backend systems to address any provisional, billing, security and data issues that might threaten the health of their networks. A Mobile Virtual Network Operator (MVNO) is a mobile operator that typically does not own its own frequency spectrum and typically does not have its own network infrastructure. Instead, MVNOs have business arrangements and contracts with third party wireless carriers to purchase usage of their networks (e.g., minutes of use, volume of data transfer, number of SMS messages, etc.) that the MVNOs in turn sell to their own subscribers. MVNOs may provision wireless devices to under a plurality of different brands and/or operate with a plurality of different networks. Accordingly, the invention has specific benefit to a MVNO.

FIG. 1 shows a process of customizing the wireless device in accordance with aspects of the disclosure. In particular, the customization process allows a wireless device to be configured to operate under a plurality of different brands and/or operate with a plurality of different networks. The customization process is associated with a customization component 100 that may be stored on a wireless device, such as the electronic device 104, described with respect to FIG. 3. The customization process and component may be implemented a number of different ways. Referring back to FIG. 1, process step 202 starts the customization process by obtaining, loading, and/or executing the customization component. For example, the customization component may include (1) a software application or the like and the software and settings may reside on the wireless device; (2) the software or settings may be delivered wirelessly to the wireless device; (3) the software may be loaded on the SIM card, and/or (4) the application may be obtained and/or purchased from an application store (e.g., Google Play, iTunes, or the like).

At process step 204, the user may be given a choice of a brand and/or a network in which to associate the wireless device. The choice may be a menu of available brands, available networks, and/or the like. Alternatively, executing a particular application may be the manner in which the user makes the choice of a particular brand and/or network. The user in this case may be an individual or a system associated with a shipping process, a distribution process, a point-of-sale process, an activation process, the seller and/or an individual or system at some intermediate point.

The customization process can allow the user to either select the brand/network or make the phone compatible with a purchased airtime card or product activation code. Another benefit to the network and brand customization is that the customization process can be tailored with specific applications and restrictions (e.g., child friendly applications and restrictions).

It may further be possible to reset the device to allow the user to select different services as desired. In particular, as shown in step 206, the customization component may include a resetting step. Thereafter, the processor can return to step 202 to allow the user to customize the wireless device. Ultimately, such a customization can allow for ease in controlling applications, experiences, safety, and controls.

Figure 2:
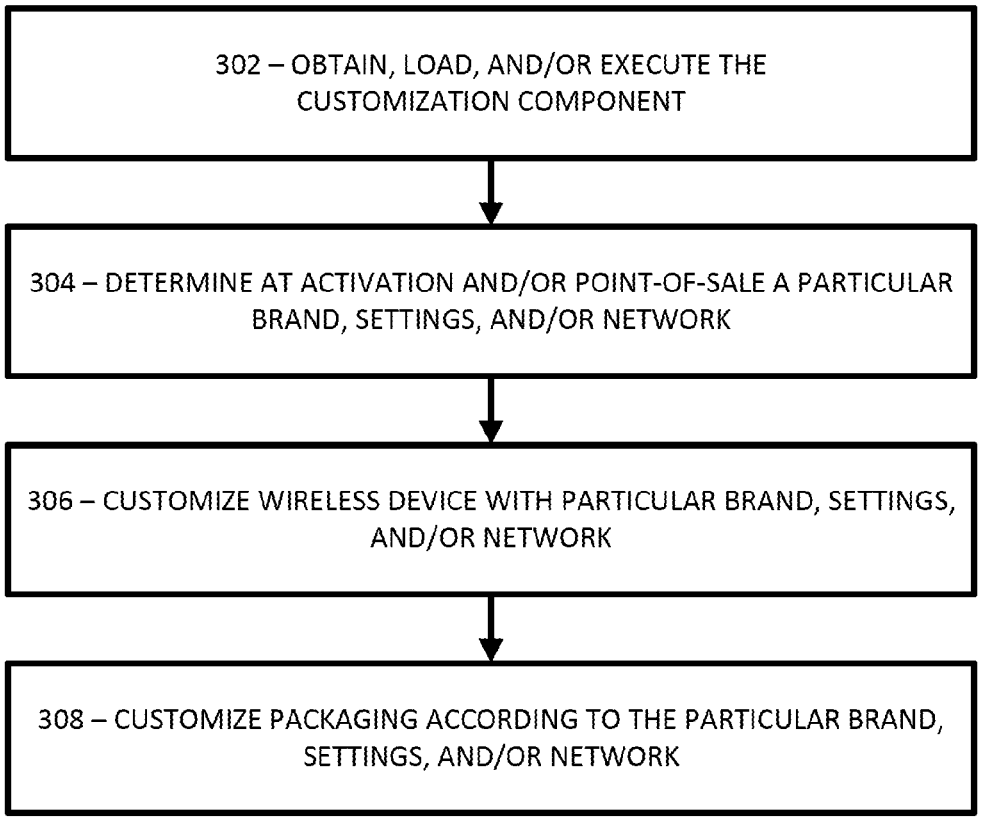
FIG. 2 shows a process of customizing the wireless device and packaging in accordance with another aspect of the disclosure.

FIG. 2 shows a process of customizing the wireless device in accordance with another aspect of the disclosure. In this approach, the customization component may be preloaded or loaded, as described above, to have retail specific applications and/or settings as shown in step 302 of FIG. 2 for a number of different retailers. For example, wireless devices sold at a number of large retailers can have applications or settings as requested by each retailer in a single customization component. For example, the settings may include a wallpaper image on the display of the wireless device that includes an image of the retailer, the brand, and/or the network. Accordingly, because the customization component contains all of the applications and/or settings for a plurality of retailers, the need to establish difficult inventory management is reduced.

As shown in step 304, before and/or during a shipping process, a distribution process, a point-of-sale process, an activation process, or at some intermediate point, the brand, settings and/or network for the device to operate under can be determined. For example, the determination may be made at the point-of-sale or at a distribution warehouse based on at least one of inventory availability, demand for a particular brand and/or network, or the like.

At step 306, the wireless device can be customized using the customization component. For example, at the distribution warehouse, at the point-of-sale before, during and/or as part of the activation of the wireless device, the wireless device may be customized using the customization component to operate under a particular brand and/or network. For example, if a wireless device is purchased at a first retail establishment, the phone can be tagged through the point-of-purchase activation to load the wireless device to the specification of the first retailer, which may increase traffic to such first retailer for purpose of purchasing airtime cards or accessories. On the other hand, if the same wireless device is purchased from a second retail establishment, the same wireless device through the point-of-purchase activation may load the wireless device to the specifications of the second retailer.

As shown at step 308, a customizable generic packaging assembly for the wireless device can be adapted according to the determined brand, settings, and/or network. Customization of the generic packaging assembly at step 308 may occur before customizing the wireless the device at step 306, or subsequent to, without consequence so long as the wireless device and packaging correspond to each other. Customization can include, for example, the addition of a label specifying the brand and/or network designated to the generic packaging assembly. The label may include but is not limited to a sticker, wrapper, plastic label, or print. Customization may include adding user agreements, disclaimer, instructions, and the like to the generic packaging. Additionally, customization may include arranging the generic packaging into a particular pre-designated packaging that includes one or more of the label, instructions, user agreement, disclaimer, and the like.

The main use cases that this would help solve are:

Having one device that covers multiple networks, and a subscription code that is obtained from one of many parameters, one of which being the activation information, point-of-sale (POS) information, and the like that determines which network configuration the device uses.

For devices maintaining billing/customer charging information, a product selection code sent out, which covers which billing platform, or mechanism that the device uses.

Brand customization, wherein devices can be branded differently, for the same billing method (For example, differentiate a Brand A device sold by a retailer vs. a Brand B device sold at the same retailer).

Brand customization, wherein devices can be branded the same, but to different retailers, in a sense providing customization/localization to each retailer.

Other market segmentation such as a child phone, elderly phone, or the like depending on demographics of customers activating the device.

Figure 3:
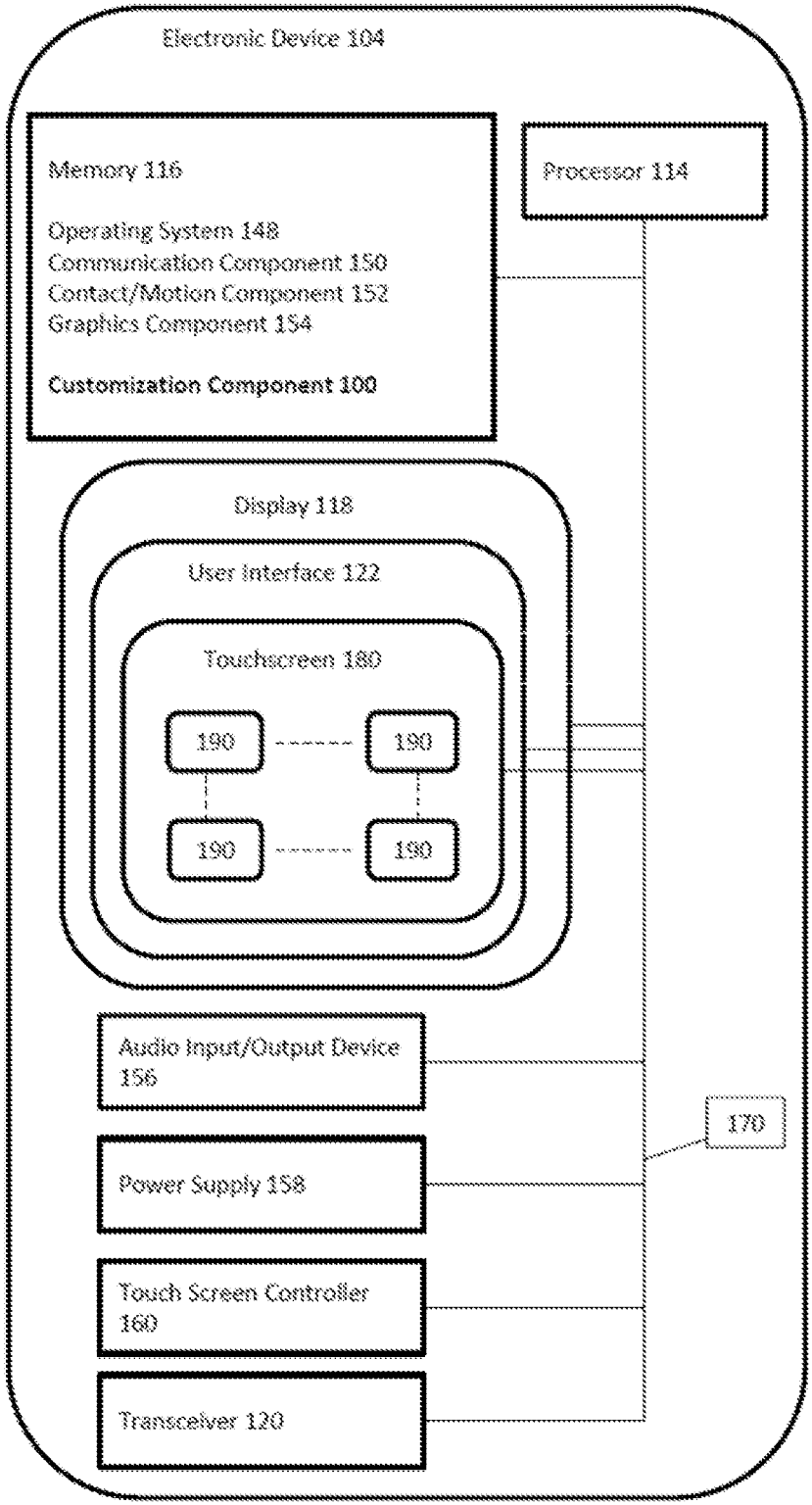
FIG. 3 illustrates details of an exemplary wireless device utilizing a customization component in accordance with aspects of the disclosure.

FIG. 3 shows the details of an exemplary electronic device in accordance with aspects of the invention. The electronic device 104 includes a processor 114, memory 116, display 118, user interface 122, and the like. The processor 114 may be a central processing unit configured to execute instructions including instructions related to software programs. The display 118 may be a liquid crystal display having a backlight to illuminate the various color liquid crystals to provide a colorful display. The user interface 122 may be any type of physical input having buttons and further may be implemented as a touchscreen 180.

The electronic device 104 may further include in the memory 116, an operating system 148, a communication component 150, a contact/motion component 152, a graphics component 154 and the like. The operating system 148 together with the various components providing software functionality for each of the components of the electronic device 104.

Additionally, in one aspect of the invention, the memory 116 may store the customization component 100. As described below, the customization component 100 may also be stored in other locations of the electronic device 104 and/or locations remote from the electronic device 104. For example, the customization component may include (1) a software application or the like and the software and settings may reside on the wireless device; (2) the software or settings may be delivered wirelessly to the wireless device; (3) the software may be loaded on a SIM card, and/or (4) the application may be obtained and/or purchased from an application store (e.g., Google Play, iTunes, or the like).

The memory 116 may include a high-speed random-access memory. Also, the memory 116 may be a non-volatile memory, such as magnetic fixed disk storage, flash memory or the like. These various components may be connected through various communication lines including a data bus 170.

Additionally, the electronic device 104 may include an audio input/output device 156. The audio input/output device 156 may include speakers, speaker outputs, and the like, providing sound output; and may include microphones, microphone inputs, and the like, for receiving sound inputs. The audio input/output device 156 may include and analog to digital converter and a digital to audio converter for audio input and output functions respectively.

When implemented as a wireless device, the electronic device 104 may include a transceiver 120 and the like. The electronic device 104 may provide radio and signal processing as needed to access a network for services. The processor 114 may be configured to process call functions, data transfer, and the like and provide other services to the user.

The touchscreen 180 of the invention may be implemented in the display 118 and may detect a presence and location of a touch of a user within the display area. For example, touching the display 118 of the electronic device 104 with a finger or hand. The touchscreen 180 may also sense other passive objects, such as a stylus.

In operation, the display 118 may display various objects 190 associated with applications for execution by the processor 114. In this regard, a user may touch the display 118, and in particular the touchscreen 180, to interact with the objects 190. For example touching an object 190 may execute an application in the processor 114 associated with the object 190 that is stored in memory 116. Additionally or alternatively, touching an object 190 may open a menu of options to be selected by the user. The display 118 may include a plurality of the objects 190 for the user to interact with. Moreover the display 118 may include a plurality of screens. The display 118 showing one screen at a time. The user may interact with the display 118 to move a screen into view on the display 118. Various objects 190 may be located in the each of the screens.

One of the objects 190 may be the customization component 100. In this regard, selecting the object 190 implementing customization component 100 may implement the process associated with FIG. 1 or the process associated with FIG. 2. Selecting the object 190 implementing customization component 100 again may reset the customization process as shown in step 206 as shown in FIG. 1.

Figure 4:
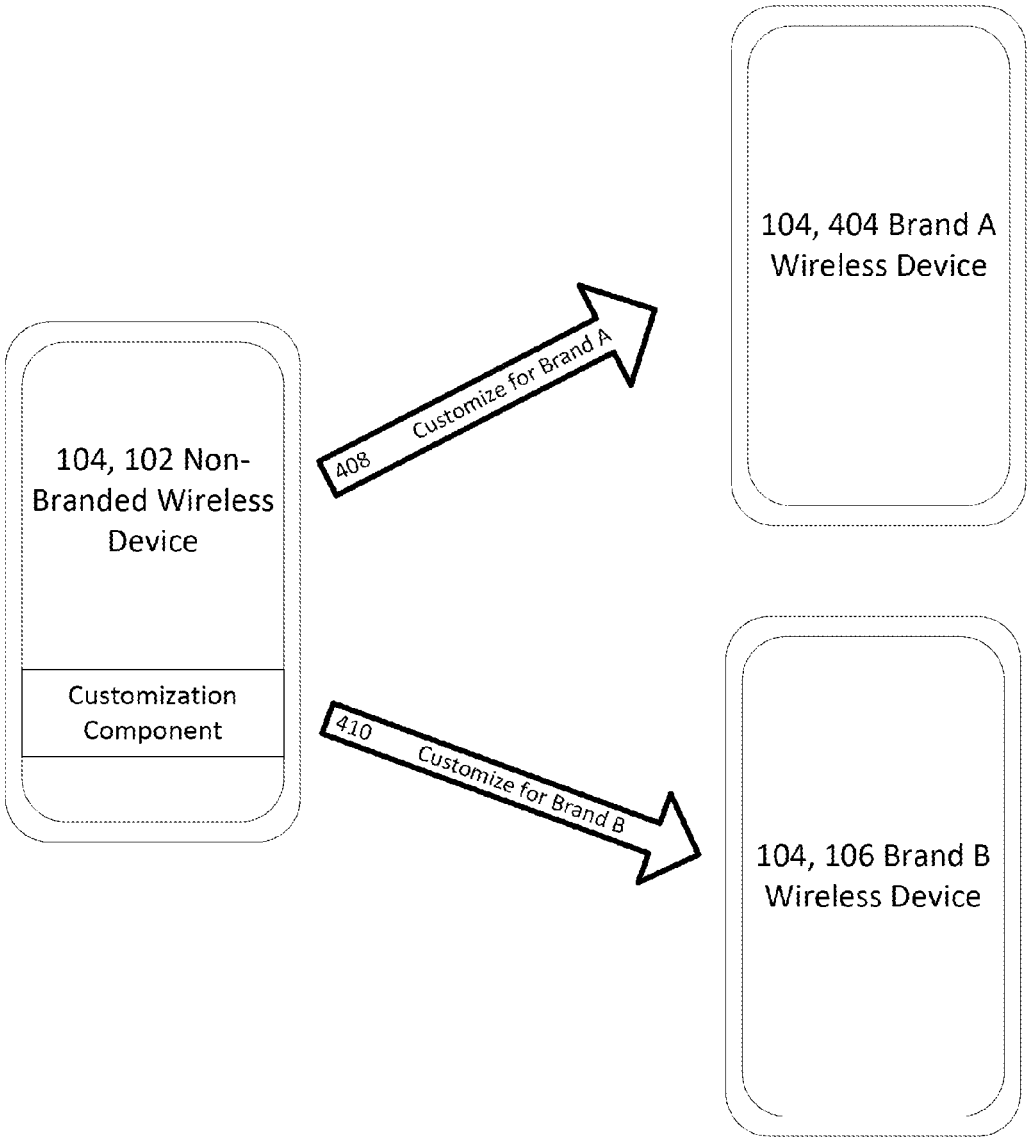
FIG. 4 illustrates an exemplary wireless device utilizing a customization component to become customized for a particular brand in accordance with aspects of the disclosure.

FIG. 4 illustrates an exemplary wireless device utilizing a customization component to become customized for a particular brand in accordance with aspects of the invention. More specifically, wireless device 104 may initially be a non-branded wireless device 402 and include the customization component 100 described above. Consistent with process step 204 described with respect to FIG. 1 or process step 306 described with respect to FIG. 2, the non-branded wireless device 402 may be customized for Brand A as shown by arrow 408; or the non-branded wireless device 402 may be customized for Brand B as shown by arrow 410. Accordingly, the resulting wireless device 104 may be customized to a Brand A wireless device 404 as shown in FIG. 4; or the resulting wireless device 104 may be customized to a Brand B wireless device 406 as shown in FIG. 4.

Figure 5:
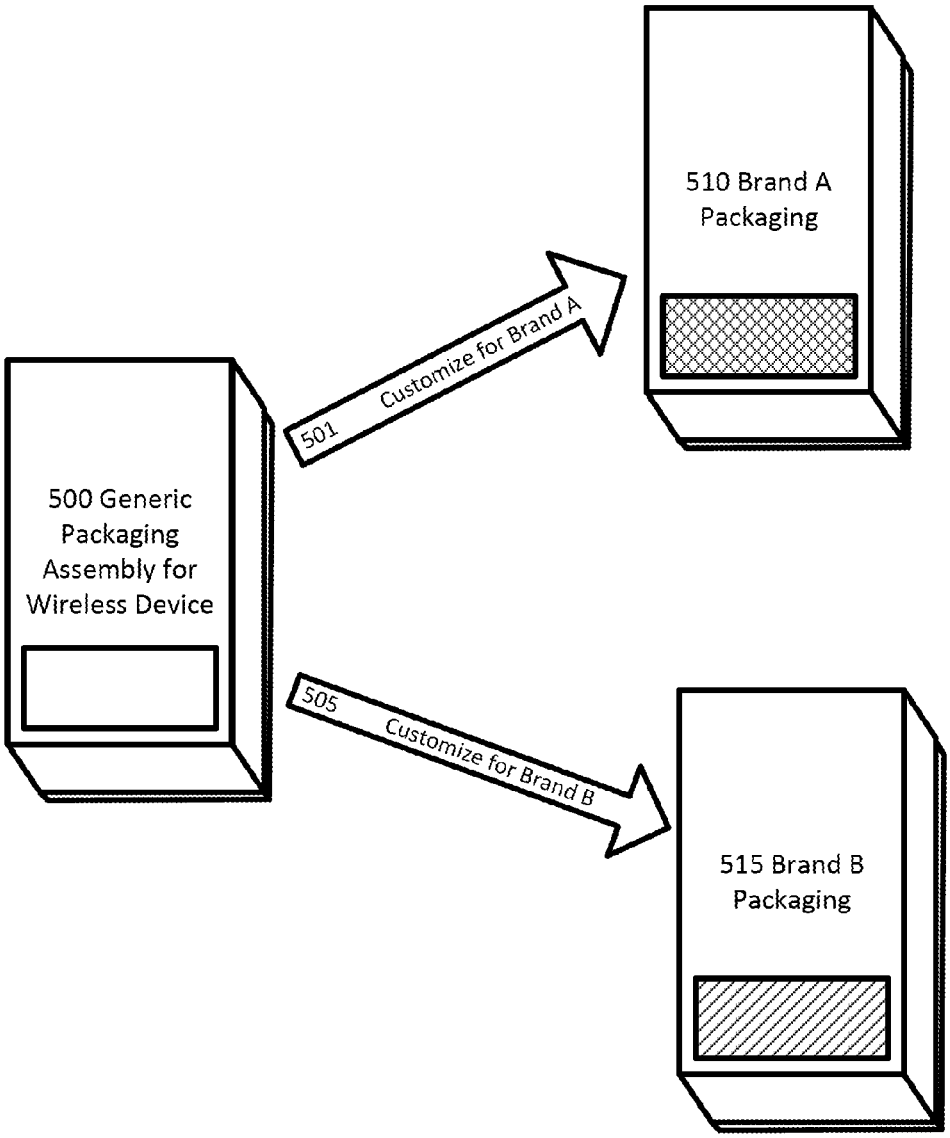
FIG. 5 illustrates an exemplary wireless device utilizing a generic packaging assembly to become customized for a particular brand in accordance with aspects of the disclosure.

FIG. 5 illustrates an exemplary wireless device utilizing a generic packaging assembly to become customized for a particular brand in accordance with aspects of the disclosure. More specifically, the generic packaging assembly 500 which may initially be a non-branded customizable packaging configured to contain a wireless device 402 with the customization component 100 described above. Consistent with process step 204 described with steps 306 and 308 described with respect to FIG. 2, the customizable generic package assembly 500 may be non-branded to be customized for Brand A as shown by arrow 501; or the customizable generic package assembly 500 may be non-branded to be customized for Brand B as shown by arrow 505. Accordingly, by means of example and in a non-limiting way, the resulting customizable packaging 500 may be customized to a Brand A package 510; or the resulting customizable packaging 500 may be customized to a Brand A package 515 as shown in FIG. 4 consistent with the disclosure herein.

Figure 6:
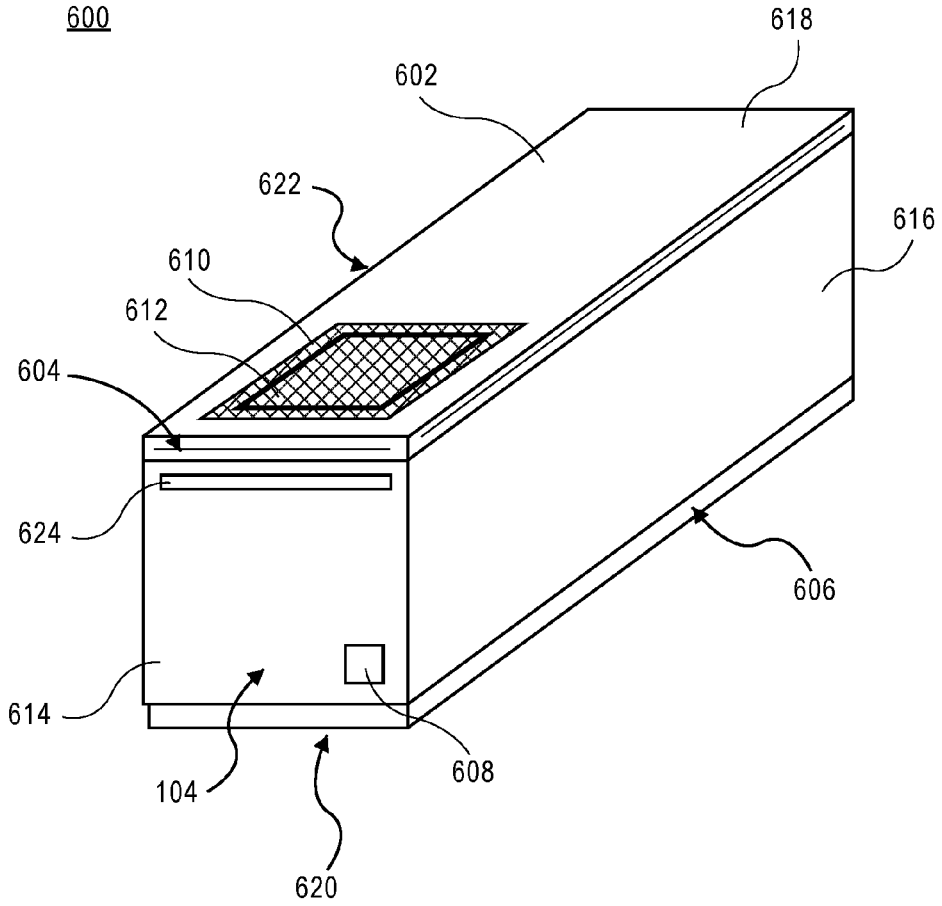
FIG. 6 illustrates an exemplary generic packaging assembly for a wireless device in accordance with additional aspects of the disclosure.

FIG. 6 illustrates an exemplary generic packaging assembly 600 for a wireless device 104 in accordance with additional aspects of the disclosure. In one aspect, the exemplary generic packaging assembly 600 may include a removable top cover 602 that includes a label receptacle portion 610 where designated brand and/or network label 612 may be placed. In additional aspects, more than one label receptacle portion 610 may be found on the generic packaging assembly 600. In some aspects, alternatively or additionally, the label receptacle portion 610 may also be found on any of the other sides 614, 616, 618, 620, 622 of the generic packaging assembly 600. In yet additional aspects, the label receptacle portion 610 may include a feature where a label 612 may be attached thereto, including for example, a plastic label 612. In addition, it may be part of a plastic wrapper, and/or a sleeve component that would include the logo of a designated brand and/or network. Additionally, the label receptacle portion 610 may include a slot 624 or the like within the packaging assembly 600 configured to receive a label 612. In particular, the slot 624 may be sized to receive the label 612 such that the label 612 can be inserted into the slot 624 into the packaging assembly 600 so as the label 612 is visible through a transparent portion of the packaging assembly 600 or the packaging assembly 600 may be substantially transparent.

Additionally, the packaging assembly 600 may include transparent portions and the packaging assembly 600 may be opened to allow the label to be inserted inside. Thereafter, the packaging assembly 600 may be closed and the label may be viewed through the transparent portions of the packaging assembly 600.

Furthermore, the packaging assembly 600 may include two portions. A first generic inner portion may hold the wireless device 104. This first generic inner portion may further hold a charging cord, generic operating instructions, or the like. The packaging assembly 600 may further include an outer packaging portion. The outer packaging portion may include the label as described above. The outer packaging portion may further include a user agreement, specific documentation for a specific brand and/or network, and the like. Accordingly, the customization process may include loading the first generic inner portion into the outer customized packaging portion to result in a finalized packaging assembly 600.

A compartment 604 may also be included to contain an instructions booklet, user agreement, disclaimer, and/or the like (documents). In some aspects, the compartment 604 is separate from the wireless device 104 compartment 606. This can allow for the easy replacement or insertion of an instructions booklet, user agreement, disclaimer, and/or the like without having to open the wireless device 104 container 606. In addition, a wire passageway 608 for inserting a wire (not shown) connecting to a port of the customizable wireless device inside of the generic package assembly 600 can be included. The wire passageway 608 may be located anywhere on the generic package assembly 600 that would allow the connection to an interface port (not shown) of the wireless device 104. The connection may be used to charge the wireless device 104, activate the device, and/or designate a brand and/or network and their corresponding settings before a customer opens the package.

Figure 7:
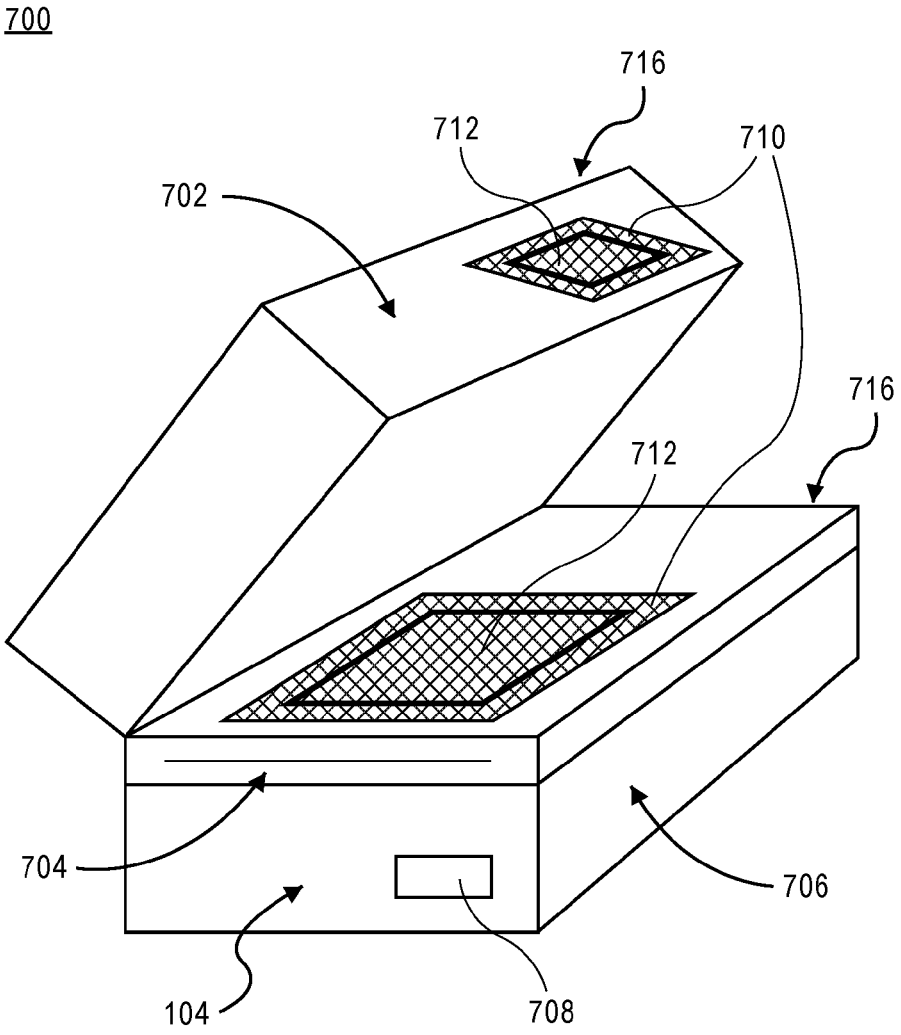
FIG. 7 illustrates another exemplary generic packaging assembly for a wireless device in accordance with aspects of the disclosure.

FIG. 7 illustrates another exemplary generic packaging assembly 700 for a wireless device 104 in accordance with aspects of the disclosure. In particular, the exemplary packaging assembly 700 contains another separate compartment 702 that can be used to include, for example, a charger or any additional equipment that may be associated with the wireless device 104. The wireless device 104 may be contained in the compartment 706, which may also include the wireless passageway 708 useful to configure and/or charge the wireless device 104 as previously described. The instructions manual 704 may be located in between compartments, as depicted, as part of compartment 702 or compartment 706, and/or adjacent thereto. In additional aspects, the instructions manual compartment 704 may be part of a sleeve (not shown) including brand and network information in which the generic package assembly can be inserted to.

Is further noted that the package assembly as described above may be constructed in any known configuration. For example, the package assembly may include one or more blister packs, cardboard box arrangements, blister pack with cardboard, and the like.

Referring back to the present exemplary generic packaging assembly 700, multiple label receptacle portions 710 can be included as depicted. Both label receptacle portions 710 may be arranged on 716 or in 714 the generic packaging assembly 700 to place a label 712 according the designated brand and/or network, or alternatively, one may be used to show the brand designated and the other may be used to show the network designated. Multiple combinations and sub-combinations will be apparent to one from the present disclosure. As a result, the previously described aspects and features are non-limiting and it is intended to cover various modifications and similar arrangements included within the spirit and scope of the claims.

Accordingly, the system and process described herein relates generally to a wireless device and associated customizable packaging that is configured for sale and operation under a plurality of different brands and with a plurality different networks, the brand and network to be utilized being designated prior to shipping, at a distribution center, at the point-of-sale, during activation, by the seller and/or at some intermediate point. The result is that inventory and distribution issues can be reduced greatly and the cost thereof reduced as well. Furthermore, the cost of packaging may be reduced as well.

For the purposes of this disclosure a computer readable medium stores computer data, which data can include computer program code that is executable by a processor of the SIM or mobile device, in machine readable form. By way of example, and not limitation, a computer readable medium may include computer readable storage media, for tangible or fixed storage of data, or communication media for transient interpretation of code-containing signals. Computer readable storage media, as used herein, refers to physical or tangible storage (as opposed to signals) and includes without limitation volatile and non-volatile, removable and nonremovable storage media implemented in any method or technology for the tangible storage of information such as computer-readable instructions, data structures, program modules or other data. Computer readable storage media includes, but is not limited to, RAM, ROM, EPROM, EEPROM, flash memory or other solid state memory technology, optical storage media, magnetic cassettes, magnetic tape, magnetic disk storage or other magnetic storage devices, or any other physical or material medium which can be used to tangibly store the desired information or data or instructions and which can be accessed by a processor or computing device. In one or more aspects, the actions and/or events of a method, algorithm or module may reside as one or any combination or set of codes and/or instructions on a computer readable medium or machine readable medium, which may be incorporated into a computer program product.

The invention may include communication channels that may be any type of wired or wireless electronic communications network, such as, e.g., a wired/wireless local area network (LAN), a wired/wireless personal area network (PAN), a wired/wireless home area network (HAN), a wired/wireless wide area network (WAN), a campus network, a metropolitan network, an enterprise private network, a virtual private network (VPN), an internetwork, a backbone network (BBN), a global area network (GAN), the Internet, an intranet, an extranet, an overlay network, a cellular telephone network, a Personal Communications Service (PCS), using known protocols such as the Global System for Mobile Communications (GSM), CDMA (Code-Division Multiple Access), W-CDMA (Wideband Code-Division Multiple Access), Wireless Fidelity (Wi-Fi), Bluetooth, and/or the like, and/or a combination of two or more thereof.

In an aspect, the invention may be implemented in any type of mobile smartphones that are operated by any type of advanced mobile data processing and communication operating system, such as, e.g., an Apple iOS operating system, a Google Android operating system, a RIM Blackberry operating system, a Nokia Symbian operating system, a Microsoft Windows Mobile operating system, a Microsoft Windows Phone operating system, a Linux operating system or the like.

Further in accordance with various aspects of the invention, the methods described herein are intended for operation with dedicated hardware implementations including, but not limited to, microprocessors, PCs, PDAs, SIM cards, semiconductors, application specific integrated circuits (ASIC), programmable logic arrays, cloud computing devices, and other hardware devices constructed to implement the methods described herein.

While the assembly and method have been described in terms of what are presently considered to be specific aspects, the disclosure need not be limited to the disclosed aspects. It is intended to cover various modifications and similar arrangements included within the spirit and scope of the claims, the scope of which should be accorded the broadest interpretation so as to encompass all such modifications and similar structures. The present disclosure includes any and all aspects of the following claims.

The invention claimed is:

1. A method of customizing a package for a wireless device configured to operate under at least a plurality of different brands and with a plurality of different networks and the wireless device, the method comprising:

providing a generic package assembly, wherein the generic package assembly comprises a compartment to contain the wireless device, and the generic package assembly comprises a label receptacle portion arranged on the generic package assembly to place a label for the wireless device;

receiving a determination of at least a brand and a network associated with the wireless device with a customization component software application executed by a processing unit of the wireless device;

configuring the wireless device according to the determination of at least the brand and network associated with the wireless device with the customization component software application, wherein the customization component software application loads the wireless device with wireless device specifications based on determining at least the brand and network;

providing at least one document based on determining at least the brand and the network with the generic packaging; and providing a label for the label receptacle portion of the generic package assembly associated with the wireless device based on determining at least of the brand and the network.

2. The method of claim 1, wherein:

the determination of said at least a brand and a network associated with the wireless device is performed at one of the following: a distributor, seller, and point-of-sale.

3. The method of claim 1, wherein the generic package assembly comprises an inner package assembly to hold the wireless device and an outer package assembly that includes the document compartment and the label receptacle portion.

4. The method of claim 1, wherein the label receptacle portion comprises at least one of the following: a label receiving surface to place the label, a label receiving slot sized to receive the label, and an inner portion of the package assembly to receive the label.

5. The method of claim 2, wherein the label comprise the label from one of a plurality of different labels associated with each of the brands and networks associated with the wireless device.

6. The method of claim 5, wherein:

selecting the label to be placed on the label receptacle portion from a plurality of labels according to the configuration of the wireless device.

7. The method of claim 2, wherein the configuring of the wireless device according to the determination of at least the brand and network associated with the wireless device utilizes the customization component software application executed by the processing unit of the wireless device.

8. The method of claim 2, further comprising:

configuring the wireless device according to the determination of at least the brand and network associated with the wireless device utilizing the customization component software application executed by the processing unit of the wireless device so that the wireless device operates under the determined at least brand and network.

9. The method of claim 8, further comprising:

selecting the document to be included in the document compartment from a plurality of documents according to the configuration of the wireless device.

10. The method of claim 7, wherein the document comprises at least one of instructions manual, instructions, disclaimer, and user agreement.

11. The method of claim 1, wherein: configuring the wireless device with the customization component software application further includes loading the wireless device with network settings based on determining at least the brand and network.

12. The method of claim 1, wherein: configuring the wireless device with the customization component software application further includes loading the wireless device with system settings and network settings based on determining at least the brand and network.

13. The method of claim 1, wherein: configuring the wireless device with the customization component software application further includes loading the wireless device with brand settings and network settings based on determining at least the brand and network.

14. A method of customizing a package for a wireless device configured to operate under at least a plurality of different brands and with a plurality of different networks and a wireless device, the method comprising:

providing a generic package assembly, wherein the generic package assembly comprises a compartment to contain the wireless device, and the generic package assembly comprises a label receptacle portion arranged on the generic package assembly to place a label for the wireless device;

receiving a determination of at least a brand and a network associated with the wireless device with a customization component software application executed by a processing unit of the wireless device;

configuring the wireless device according to the determination of at least the brand and network associated with the wireless device with the customization component software application, wherein the customization component software application loads the wireless device with wireless device specifications based on determining at least the brand and network;

providing at least one document based on determining at least the brand and the network with the generic packaging; and providing a label for the label receptacle portion of the generic package assembly associated with the wireless device based on determining at least the brand and the network, wherein the configuring of the wireless device according to the determination of at least the brand and network associated with the wireless device utilizes the customization component software application executed by the processing unit of the wireless device; and wherein the determination of said at least a brand and a network associated with the wireless device is performed at one of the following: a distributor, seller, and point-of-sale.

15. The method of claim 14, wherein: configuring the wireless device with the customization component software application further includes loading the wireless device with network settings based on determining at least the brand and network.

16. The method of claim 14, wherein: configuring the wireless device with the customization component software application further includes loading the wireless device with system settings and network settings based on determining at least the brand and network.

17. The method of claim 14, wherein: configuring the wireless device with the customization component software application further includes loading the wireless device with brand settings and network settings based on determining at least the brand and network.

18. The method of claim 14, further comprising:

configuring the wireless device according to the determination of at least the brand and network associated with the wireless device utilizing the customization component software application executed by the processing unit of the wireless device so that the wireless device operates under the determined at least one brand and/or network.

19. The method of claim 14, wherein the document comprises at least one of instructions manual, instructions, disclaimer, and user agreement.

20. The method of claim 14, wherein the label comprise the label from one of a plurality of different labels associated with each of the brands and networks associated with the wireless device.

21. The method of claim 14, wherein the configuring of the wireless device according to the determination of at least the brand and network associated with the wireless device utilizes the customization component software application executed by the processing unit of the wireless device.

* * * * *